US005810071A

United States Patent [19]

Pavlin

[11] Patent Number: 5,810,071

[45] Date of Patent: Sep. 22, 1998

[54] HEAT EXCHANGER

[75] Inventor: Jaroslav Pavlin, Freiberg, Germany

[73] Assignee: Filterwerk Mann & Hummel GmbH, Ludwigsburg, Germany

[21] Appl. No.: 751,418

[22] Filed: Nov. 18, 1996

Related U.S. Application Data

[63] Continuation of Ser. No. 379,547, filed as PCT/EP94/01788, Jun. 1, 1994, abandoned.

[30] Foreign Application Priority Data

Jun. 3, 1993 [DE] Germany ..... 9309741 U

[51] Int. Cl.[6] ..... F28F 27/02; F28F 3/08; F28F 3/10

[52] U.S. Cl. ..... 165/284; 165/167; 165/916; 123/196 AB

[58] Field of Search ..... 165/916, 167, 165/284; 123/196 AB

[56] References Cited

U.S. PATENT DOCUMENTS

| | | | |
|---|---|---|---|
| 2,511,084 | 6/1950 | Shaw . | |
| 3,743,011 | 7/1973 | Frost | 165/38 |
| 4,193,442 | 3/1980 | Vian | 123/196 AB |
| 4,423,708 | 1/1984 | Sweetland | 123/196 AB |
| 4,424,778 | 1/1984 | Yoshida | 123/196 AB |
| 4,708,199 | 11/1987 | Yogo et al. . | |
| 4,831,980 | 5/1989 | Nasu et al. | 123/196 AB |
| 4,892,136 | 1/1990 | Ichihara et al. | 165/916 |
| 4,987,955 | 1/1991 | Bergvist et al. . | |
| 5,014,775 | 5/1991 | Watanabe | 123/196 AB |
| 5,099,912 | 3/1992 | Tajima et al. | 165/916 |
| 5,165,468 | 11/1992 | Tajima et al. | 165/916 |
| 5,351,664 | 10/1994 | Rotter et al. | 165/916 |

FOREIGN PATENT DOCUMENTS

| | | | |
|---|---|---|---|
| 289424 | 9/1990 | European Pat. Off. . | |
| 2303944 | 11/1976 | France . | |
| 2634276 | 1/1990 | France . | |
| 7115268 | 7/1971 | Germany . | |
| 3210114 | 9/1983 | Germany . | |
| 3536316 | 4/1987 | Germany . | |
| 3923936 | 1/1991 | Germany . | |
| 4106963 | 9/1992 | Germany | 165/167 |
| 9318635.5 | 2/1994 | Germany . | |
| 0073089 | 4/1987 | Japan | 165/916 |
| 4-113195 | 4/1992 | Japan | 165/167 |
| 5-1890 | 1/1993 | Japan | 165/916 |
| 5-118774 | 5/1993 | Japan | 165/167 |
| 2270971 | 3/1994 | United Kingdom | 165/916 |
| WO 88/09473 | 12/1988 | WIPO . | |

OTHER PUBLICATIONS

Abstract of Published German Patent Application No. DE 3,210,114 (no date).

Abstract of Published German Patent Application No. DE 3,536,316 (no date).

Abstract of Published German Patent Application No. DE 3,923,936 (no date).

Abstract of Published French Patent Application No. FR 2,303,944 (no date).

Abstract of Published French Patent Application No. FR 2,634,276 (no date).

Abstract of Published European Patent Application No. EP 289,424 (no date).

*Primary Examiner*—John K. Ford

*Attorney, Agent, or Firm*—Evensnon, McKeown, Edwards & Lenehan, PLLC

[57] ABSTRACT

A heat exchanger, in particular an oil cooler for internal combustion engines, composed of several parallel tubes (19) for the heat exchange medium and of lamellar, plate-like heat exchange elements (10) arranged perpendicular to the tubes and fixed thereto. The heat exchange elements (10) are bent at their outer edges (11) and are nested on top of each other. An adapter element (13) is provided for supplying the medium to be cooled. The adapter element (13) has liquid inlet (15), a liquid outlet (18) and a mounting member (14) for the heat exchanger.

4 Claims, 2 Drawing Sheets

HEAT EXCHANGER

This application is a continuation of application Ser. No. 08/379,547, filed as PCT/EP94/01788, Jun. 1, 1994 now abandoned.

The invention relates to a heat exchanger, particularly an oil cooler for internal-combustion engines, comprising several tubes arranged parallel to one another for conducting the heat exchange medium, as well as lamellar, plate-shaped heat exchange elements which are arranged perpendicularly to the tubes and are fixedly connected to the tubes, the plate-shaped heat exchange elements being bent over at the outer edges and being nested one above the other.

From published German Patent Application DE-OS 3,210,114, a heat exchanger and, in particular, a cooler for motor vehicles is known. This heat exchanger comprises several tubes arranged parallel to each other for conducting the heat exchange medium. These tubes open into an upper and a lower water chamber. The heat exchanger also comprises lamellar, plate-shaped heat exchange fins which are arranged perpendicularly to the tubes and are fixedly attached to the tubes. On their frontal edges, these heat exchange fins are provided with bent over end portions which are nested one above the other and thus form side parts on which mounting devices for angles may be arranged.

The known heat exchanger, which is constructed of relatively simple elements and has a good heat transmission, has the disadvantage that in order to attach the heat exchanger to a support, additional angles are required. In addition, the connections for the heat exchange medium are defined in the upper and the lower water chambers. The invention is therefore based on the object of providing a heat exchanger which can be used universally and can be fastened to any desired connection structures without any increase in its overall size.

Starting from the preamble of the main claim, this object is achieved by means of the characterizing features of the claim.

As significant advantage of the innovation is that it is possible by means of an adapter element to combine the liquid inlet as well as the liquid outlet and the mounting for the heat exchanger in a single unit.

In accordance with a further embodiment of the invention, a pressure relief valve may simultaneously be arranged in the adapter element, which pressure relief valve in the cold-operation phase forms a bypass for the medium to be cooled.

One embodiment of the adapter element comprises a plate which is integrated in the last heat exchange element. By means of the integration of this plate, the overall height of the entire heat exchange element is increased only insignificantly. However, at the same time, all connections are contained in this adapter plate. In one advantageous embodiment of the innovation, the connecting tubes for the heat exchange medium may be arranged opposite the adapter element. Naturally, it is also possible to integrate the connecting tubes into the adapter element and thereby to further increase the functions of this element.

An advantageous combination of materials for the heat exchanger consists of the use of a solder-plated aluminum sheet metal. This can be soldered so that it becomes possible, to assemble the heat exchanger by heating it, for example, in continuous furnaces.

In addition to being found in the claims, these and other features of preferred embodiments of the innovation are also found in the specification and the drawings, in which case the individual features in the embodiments of the innovation may each be implemented separately or combined in the form of subcombinations and may be utilized in other fields, and may represent advantageous and individually protectable embodiments for which protection is claimed here:

The innovation will be described in further detail hereinafter with reference to an illustrative working embodiment.

Figure 1:
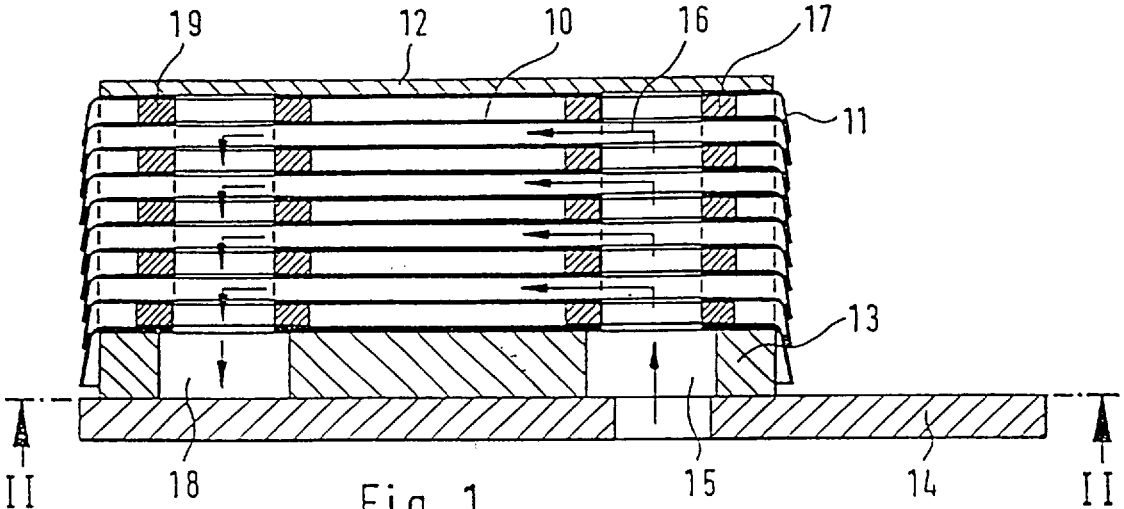
FIG. 1 shows a schematic view of a heat exchanger whose side portions are formed by bent-over fins.

FIG. 1 schematically depicts a heat exchanger which comprises a plurality of plate-shaped heat exchange elements 10 arranged parallel to one another and through which a heat exchange medium flows. On the surrounding outer edges 11, the heat exchange elements 10 are bent over and are stacked nested lamellarly above one another to form a heat exchanger stack. A cover plate 12 forms the upper end of the heat exchanger stack. The lower end is formed by an adapter element 13 in combination with a mounting plate 14. Adapter element 13 and mounting plate 14 may be made in one piece. However, it is also possible to form this in two pieces from two stamped parts. The connection of the individual heat exchanger elements 10 to one another as well as to the cover plate 12 and the adapter element 13 takes place by means of soldering. For this purpose, the individual structural members are coated. The entire stack, together with the individual components, including the sealing rings 17, 19, which are not shown here, is heated and the individual components are thereby soldered to one another.

The medium to be cooled, for example oil, flows through the bore 15 in the mounting plate 14 and the adapter element 13 into the heat exchanger, is distributed there over the individual levels in accordance with the arrows 16, and leaves the heat exchanger via the bore 18.

Figure 2:
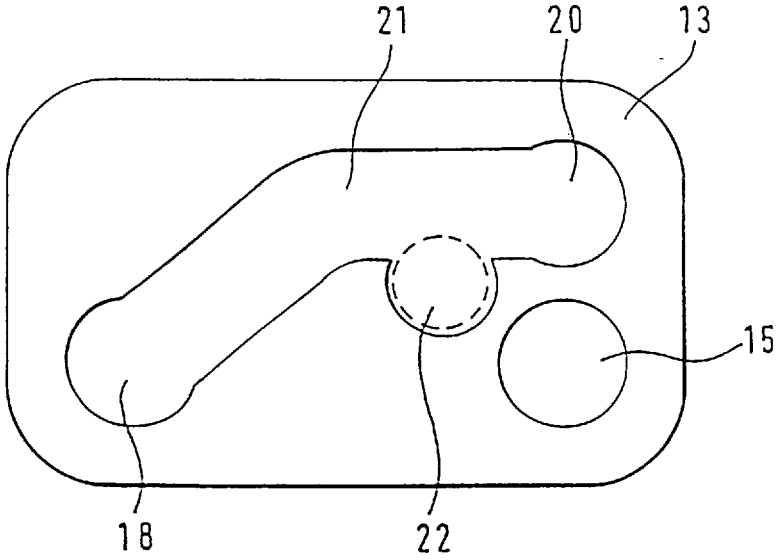
FIG. 2 shows a top view of the adapter plate depicted in a sectional view in FIG. 1.

FIG. 2 shows a top view of the adapter element 13. This adapter element 13 contains a bore 15 for the oil feed as well as a bore 18 for the oil return flow. Since the oil return flow must take place via a duct means which is situated in the area of the bore 20, there is a connection 21 in the adapter element between bore 18 and bore 20. In addition, a bore 22 for a pressure relief valve, which will be explained below, is provided in this area.

It can be seen from this illustration that both the feed bores for the oil to be cooled and also the ducts for the further transmission can be positioned at any desired points. The adapter plate makes it possible to connect the heat exchanger to any desired type of connection. Naturally, it is also possible to construct the adapter elements with stems, recesses or the like, and to thereby adapt them to a number of different fastening structures.

Figure 3:
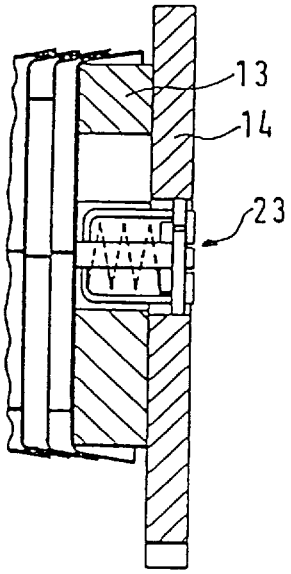
FIG. 3 shows a sectional view of the adapter plate with a built-in pressure relief valve.

FIG. 3 illustrates the arrangement of a pressure relief valve 23. This pressure relief valve 23 is arranged in the mounting plate 14 and extends into the space of the adapter element 13. Above a predetermined differential pressure between the inlet side and the outlet side, the pressure relief valve acts to produce a direct connection between these two sides.

Figure 4:
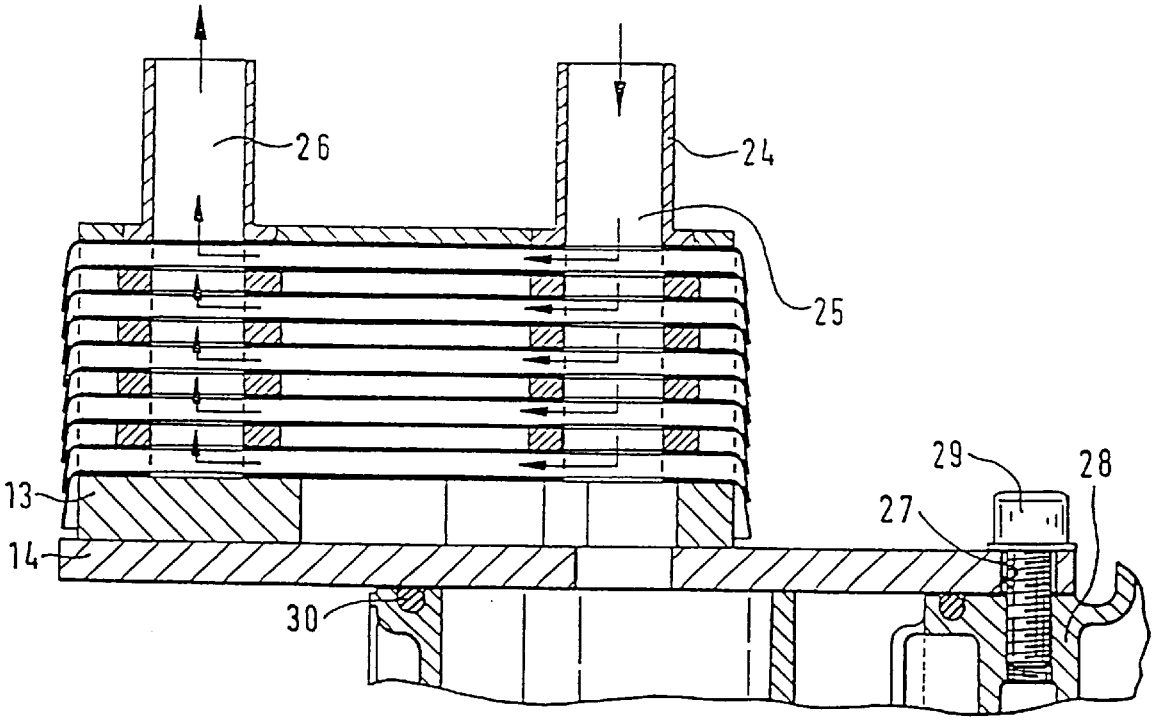
FIG. 4 shows a sectional view of the heat exchanger with the inlet and the outlet for the heat exchange medium.

FIG. 4 illustrates a heat exchanger in a manner similar to FIG. 1; however, here the section plane is situated in the area of the feed and discharge lines for the heat exchange medium. The heat exchange medium flows through the connection 24 into the heat exchanger; flows through the heat exchanger in accordance with the arrows 25; absorbs the heat of the parallel-flowing medium to be cooled; and leaves the heat exchanger through the connection 26.

The mounting plate 14 is attached by means of screws 29 to a part 28 produced by casting, for example a filter base body. In order to provide a seal between the mounting plate 14 and the part 28, a groove 30 is cast therein in which a sealing ring or a sealing element is inserted. As a result of this sealing, it is not necessary to machine the cast part 28. Thus, a tight connection between the oil cooler and the external structure of a filter base body is provided at a low manufacturing cost.

I claim:

1. A heat exchanger comprising:

a plurality of heat exchange medium connections arranged parallel to one another for conducting a heat exchange medium to and from the heat exchanger;

a plurality of plate-like, lamellar heat exchange elements arranged perpendicularly to and fixedly attached to the heat exchange medium connections, said heat exchange elements being bent over at outer edges thereof and being nested one above another;

an adapter element consisting of a first flat plate having passageways formed therein leading from a fluid inlet to said heat exchange elements and from said heat exchange elements to a fluid outlet, said first flat plate being received and mounted within an end one of said plate-shaped heat exchange elements;

a mounting member for the heat exchanger consisting of a second flat plate abutted to a face of said adapter element;

duct means through which a fluid to be heat exchanged with said heat exchange medium is supplied to and discharged from the heat exchanger, said duct means being arranged perpendicularly to the heat exchange elements and communicating with the fluid inlet and the fluid outlet of said adapter element; and a pressure relief valve arranged in the mounting member and extending into said adapter element.

2. A heat exchanger according to claim 1, wherein said heat exchange medium connections are arranged on an opposite side of said heat exchanger from said adapter element.

3. A heat exchanger according to claim 1, wherein said heat exchange medium connections, said heat exchange elements, and said adapter element are formed of solder-plated aluminum.

4. A heat exchanger according to claim 1, wherein said heat exchange elements and said heat exchange medium connections are formed of solder-plated aluminum.

* * * * *